US005322344A

United States Patent [19]

Hoffman et al.

[11] Patent Number: 5,322,344

[45] Date of Patent: Jun. 21, 1994

[54] SOFA TABLE AND MECHANISM FOR USE WITH A SOFA HAVING A FOLDABLE BED

[75] Inventors: D. Stephen Hoffman, High Point; W. Clark Rogers, Denton, both of N.C.

[73] Assignee: Ultra-Mek, Denton, N.C.

[21] Appl. No.: 29,765

[22] Filed: Mar. 11, 1993

Related U.S. Application Data

[63] Continuation-in-part of Ser. No. 922,563, Jul. 30, 1991.

[51] Int. Cl.[5] ..... A47C 7/62

[52] U.S. Cl. ..... 297/191; 297/113; 297/238; 297/194; 297/411.32

[58] Field of Search ..... 297/417, 191, 411, 146, 297/238, 113, 194; 5/12.1, 13, 43, 45, 46

[56] References Cited

U.S. PATENT DOCUMENTS

| | | | |
|---|---|---|---|
| 3,666,319 | 5/1972 | Moloney | 297/113 |
| 3,951,448 | 4/1976 | Hawie | 297/191 X |
| 4,541,133 | 9/1981 | Reiss et al. | 5/13 |
| 4,558,901 | 12/1985 | Yokoyama | 297/113 |
| 4,571,756 | 2/1986 | Castro et al. | 5/13 X |
| 4,579,384 | 4/1986 | Sharod | 297/113 |
| 4,779,923 | 10/1988 | Lang et al. | 297/113 X |
| 5,104,182 | 4/1992 | Rasnick et al. | 297/113 |

FOREIGN PATENT DOCUMENTS

| | | | |
|---|---|---|---|
| 284491 | 2/1928 | United Kingdom | 297/113 |
| 438897 | 11/1935 | United Kingdom | 297/113 |

OTHER PUBLICATIONS

Drawing of Folding Sofa Back, Ultra-Mek, Inc., P.O. Box 518, Denton, N.C. 27239.

*Primary Examiner*—Peter M. Cuomo
*Assistant Examiner*—Jerry Redman
*Attorney, Agent, or Firm*—Bell, Seltzer, Park & Gibson

[57] ABSTRACT

A mechanism for use with a sofa table movable between a retracted closed position and a generally horizontal open position is disclosed. The mechanism is particularly suited for use with a sofa to which is attached a foldable bed. The mechanism comprises: a mounting link adapted for mounting the mechanism to a sofa frame; a lower pivot link pivotally interconnected to the mounting link; a table mounting bracket pivotally interconnected to the lower pivot link and adapted to be fixed to a sofa table; and an upper pivot link pivotally interconnected to the mounting link and further pivotally interconnected with the table mounting bracket. The lower pivot link includes a bend between its pivots disposed toward the upper pivot link within which the head portion of a foldable bed in its fold position can reside when the sofa table is in its closed position.

14 Claims, 5 Drawing Sheets

SOFA TABLE AND MECHANISM FOR USE WITH A SOFA HAVING A FOLDABLE BED

RELATED APPLICATIONS

This application is a continuation-in-part of pending U.S. patent application Ser. No. 07/922,563, filed Jul. 30, 1990 for SOFA TABLE AND MECHANISM.

FIELD OF THE INVENTION

The present invention relates generally to movable sofa tables, and relates more specifically to an improved mechanism for a retractable sofa table used with a sofa which also includes a foldable bed.

FIELD AND BACKGROUND OF THE INVENTION

Many sofa models include a retractable sofa table, which is a device that folds from an upright position within a recessed area in the backrest of the sofa to a horizontal position resting just above or upon the seating surface of the sofa, where it can serve as a table surface. See, e.g., U.S. Pat. No. 5,104,182 to Rasnick et al. Sofa tables are generally moved between these positions by some type of mechanism that is attached to the table itself and to some solid support within the backrest. Sofa tables have proven quite popular with consumers, who appreciate the convenience of having a table surface integrated into the sofa for storage of drinks, easy access of reading materials, and the like.

However, to date sofa tables have been unable to overcome certain shortcomings which have limited their use to specific sofa styles. The major shortcomings lie in the mechanism used to control the movement of the sofa table. Known mechanisms, such as that illustrated in Rasnick et al., are exposed visually in the open position to an observer facing the front surface of the backrest; these exposed linkages are aesthetically unpleasing. In addition, the mechanisms known to date are designed so that the thickness of the table section, including the table surface and the cushioned upholstered surface on the opposite surface of the table, is somewhat limited. This of course restricts the use of sofa tables to certain styles of sofas in which relatively thin cushions are used for the backrest. A further limitation of present sofa tables is the forward-to-rearward length of the table surface. Clearly, this dimension is limited by the height of the backrest and the mounting position of the mechanism. See Rasnick et al., supra, in which the mechanism is mounted approximately level with the upper surface of the table. However, prior art mechanisms have not taken full advantage of the space available within the cavity of the sofa backrest; in particular, the storage volume beneath the backrest and directly rearward of the seat has not been utilized. Finally, prior art mechanisms have not been suitable for inclusion on a sofa to which is attached and in which is stored a foldable bed, as the configuration of the foldable bed in its closed position interferes with the operation of the mechanism.

It is therefore an object of the present invention to provide a mechanism suitable for use with a sofa table which is not visible in the open position to an observer facing the backrest cushion.

It is a further object of the present invention to provide a sofa table and accompanying mechanism which are configured to permit the use of thicker sofa table units.

It is an additional object to provide a mechanism which permits the use of a sofa table which is longer from front-to-rear than those currently known in this art.

It is also an object of the present invention to provide a sofa table suitable for use with a sofa which includes therein a foldable bed.

SUMMARY OF THE INVENTION

These objects and others are satisfied by the present invention, which as a first aspect provides a mechanism suitable for use with a retractable sofa table comprising means adapted for mounting the mechanism to a sofa frame, a lower pivot link pivotally interconnected to the mounting means, a table mounting bracket pivotally interconnected to the lower pivot link and configured to be fixed to a sofa table unit, and an upper pivot link pivotally interconnected to the mounting means, and further pivotally interconnected to the table mounting bracket. The upper pivot link includes between its pivot a bend disposed toward the lower pivot link which is configured to accept within the bend the profile of a sofa table.

A second aspect of the present invention is a mechanism suitable for use with a retractable sofa table comprising means adapted for mounting the mechanism to a sofa frame, a lower pivot link pivotally interconnected to the mounting means, a table mounting bracket pivotally interconnected to the lower pivot link and configured to be fixed to a sofa table unit, and an upper pivot link pivotally interconnected to the mounting means and further pivotally interconnected with the table mounting bracket. The mounting means and upper pivot link are configured so that in an open position, all of the mechanism lies beneath a plane defined by the upper surface of an attached sofa table.

A third aspect of the present invention is a sofa table having an upper support surface, the upper support surface including a hinged storage compartment.

A fourth aspect of the present invention is a sofa table mechanism which can be used in conjunction with a sofa having an attached foldable bed stored within the cavity of the sofa. This mechanism comprises: means adapted for mounting the mechanism to a sofa frame; a lower pivot link pivotally interconnected to the mounting means; a table mounting bracket pivotally interconnected to the lower pivot link and adapted to be fixed to a sofa table; and an upper pivot link pivotally interconnected to the mounting means and further pivotally interconnected with the table mounting bracket. The lower pivot link includes a bend between its pivots disposed toward the upper pivot link. In a first closed position, the table mounting bracket is in a first rotative orientation relative to the mounting means, and in a second open position, the table mounting bracket is in a second rotative orientation relative to the mounting means. The angular difference between the first rotative position and the second rotative position is between about 70° and 140° degrees.

A fifth aspect of the present invention is a sofa having a foldable bed which includes a sofa table mechanism as described above.

DETAILED DESCRIPTION OF THE INVENTION

The present invention will now be described more particularly hereinafter with reference to the accompanying drawings, in which present embodiments of the invention are shown. The invention, can, however, be embodied in many different forms and should not be limited to the embodiments set forth herein; rather, these embodiments are provided so that this disclosure will be thorough and complete, and will fully convey the scope of the invention to those skilled in the art.

Figure 1:
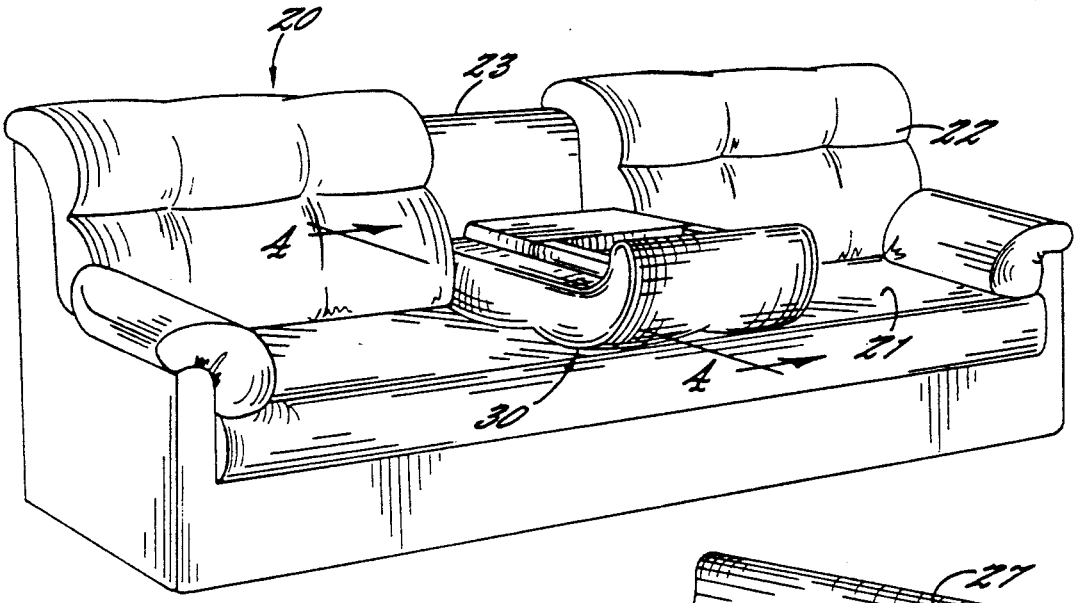
FIG. 1 shows a perspective view of a sofa having a sofa table, the sofa table being in the open position.
Figure 2:
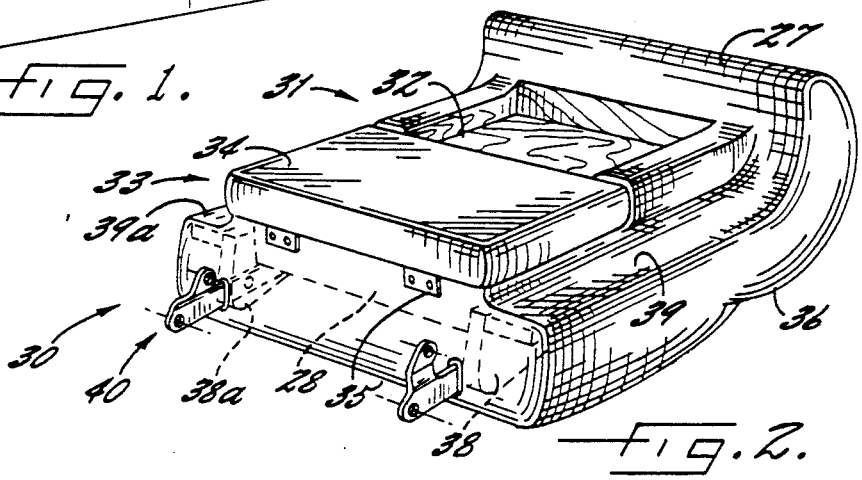
FIG. 2 shows a perspective view of a sofa table showing a recessed compartment and a hinged compartment.
Figure 3:
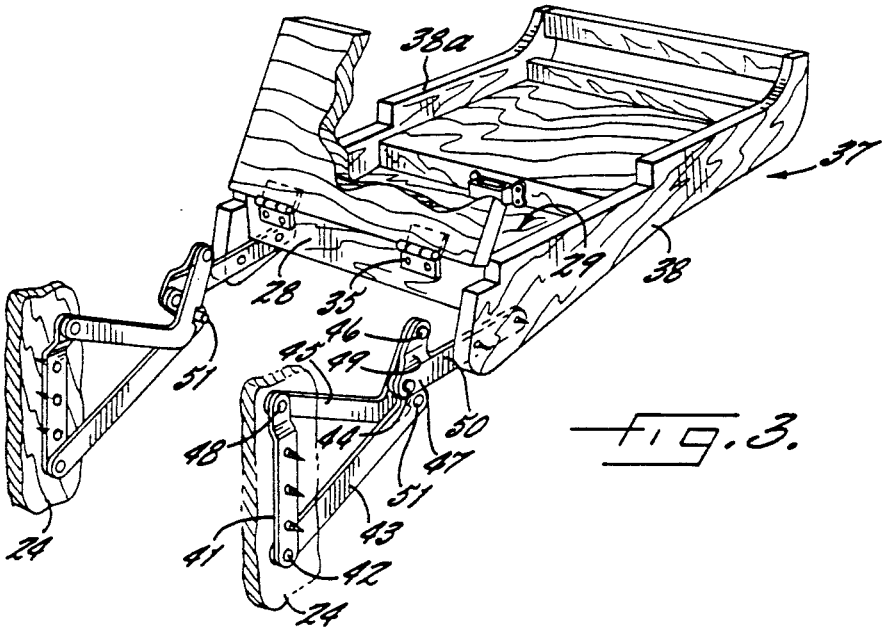
FIG. 3 is cut-away view of a sofa table frame and a mechanism connecting the sofa table to side panels of a sofa.

A current embodiment of the invention is shown in FIGS. 1-5. A sofa, broadly designated at 20, is shown in FIG. 1. The sofa includes a seat surface 21, a back surface 22 and a recessed area 23. Lining the vertical edges of the recessed area 23 are a pair of side panels 24, 24*a*. Within the recessed area 23 fits a sofa table 30 which is attached to side panels 24, 24*a* by a pair of mechanisms 40. It is noteworthy that the mechanisms 40 are mounted on the lower portion of the side panels 24, 24*a* which reside beneath the backrest 22 and just rearward of and below the seat surface 22. While a sofa is illustrated herein, it will be appreciated by those skilled in this art that any type of seating unit, including a chair, love seat, pit sofa, and the like having a backrest and a seat is suitable for use with the sofa table and mechanism described herein.

The sofa table 30 (FIG. 2) includes a frame 37 (FIG. 3) which includes a pair of lateral side panels 30 to which are attached a pair of arm rests 39, 39*a*. The downwardly facing surface of the sofa table 30 (as seen in the open position shown in FIG. 4) comprises an upholstered surface 36; the opposite upwardly facing surface comprises an upholstered upper support surface 31, which includes a planar rectangular recessed compartment 32 and a storage compartment 33. The storage compartment 33 comprises a container portion 29, a upholstered lid 34 and a pair of hinges 35. The hinges 35 are fixed to the frame 37 at its rear edge 28. At the forwardmost edge of the sofa table 30 is an arcuate portion 27 which conforms to the top portion of the recessed area 23 of the sofa 20 when the sofa table 30 is in the closed position.

A pair of sofa mechanisms 40 connect the sofa 20 with the sofa table 30. The mechanisms are mirror images of one another about a vertical plane through the center of the sofa table 30 parallel to the side panels 38, 38*a*. For clarity, only one of the pair of mechanisms 40 will be described in detail herein.

Figure 5:
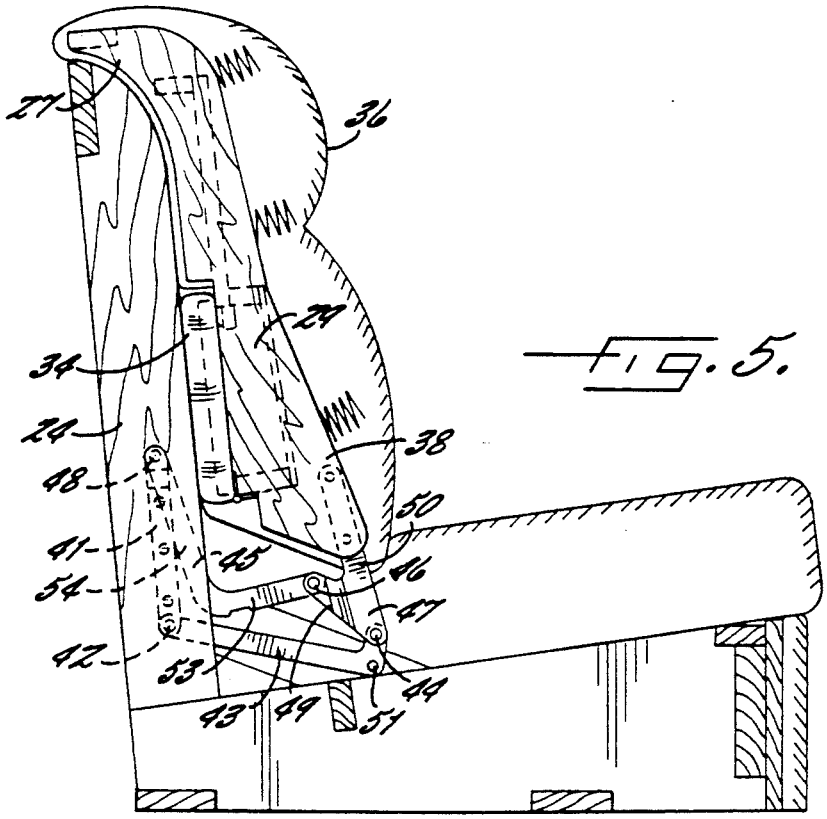
FIG. 5 is a side view of a sofa table and mechanism in a closed position.

The sofa mechanism 40 is fixedly mounted by a mounting link 41 to the backrest side panel 24 of the sofa, although those skilled in this art will appreciate that any means for mounting the mechanism to the backrest side panel 24, such as bolts or screws which provide pivot points for links interconnected to the side panel 24, is suitable for use with the present invention. The mechanism 40 comprises the mounting link 41, a lower pivot link 43, an L-shaped upper pivot link 45 and a mounting bracket 47. The lower pivot link 43 is pivotally interconnected to the mounting link 41 at pivot 42. The lower pivot link 43 also includes a stop pin 51 on its interior surface. The upper pivot link 45 is pivotally connected to the mounting link 41 at pivot 4*e*. The mounting bracket 47 includes a pivot arm 49, and a table arm 50. The mounting bracket 47 is pivotally interconnected to the upper pivot link 45 at one end of the pivot arm 49 at pivot 46 and is further pivotally interconnected at the other end of the pivot arm 49 to the lower pivot link 43 at pivot 47. The table arm 50 is fixed to the interior surface of the side panel 38 of the sofa table The upper pivot link 45 as illustrated is L-shaped, which is an advantageous configuration in its interaction with the sofa table 30, particularly when combined with the low mounting location of the mounting link 41 on the side panel 24. As seen in FIG. 5, in the closed position, a first portion 53 of the upper pivot link 45 is disposed beneath the rear edge 28 of the sofa table 30, and a second portion 54 of the upper pivot link 45 is disposed rearward of the upper support surface 31 of the sofa table 30; in essence, the upper pivot link 45 "wraps around" the lower edge 28 and upper support surface 31 of the sofa table 30. Because the vertex of the "L" is disposed toward the lower pivot link 43, a cavity is provided in which the lower edge 28 of the sofa table 30 can reside in the closed position. Those skilled in this art will appreciate that, because the storage cavity described extends into the space below the backrest 22 and rearward of and below the seat surface 21, the storage cavity is enlarged over prior art models. Consequently, the upper support surface 31 can be lengthened to fill this enlarged cavity, thereby providing a larger table surface for the occupant. In addition, the armrests 39, 39*a* can be lengthened rearwardly for greater seating comfort.

Further, the L-shape of the upper pivot link 45 also causes the aforementioned storage cavity formed in the vertex of upper pivot link 45 to be able to retain a thicker sofa table 30 than prior sofa table mechanisms. This provides the furniture designer with the option of including a storage compartment 33 which is sufficiently deep to be useful to the occupant while still retaining a sufficiently thick cushion beneath upholstered surface 36 that occupant comfort is not compromised. The container portion 29 of the storage compartment 33 is sufficiently deep that it can be used to store items within, such as reading or writing materials, playing cards, television or stereo remote control devices, and the like.

This lengthening of the upper support surface 31 and the armrests 39, 39*a* and the thickening of the sofa table 30 can be accomplished simultaneously with inboard mounting of the table arm 50 of the mounting bracket 47 on the side panel 38 (i.e., the table arm 50 is mounted to the interior surface of the side panel 38). Inboard mounting of the table arm 50 and low mounting of the mounting link 41 on the side panel 24 removes virtually all of the linkages of the mechanism 40 from the view of an onlooker facing the front surface of the backrest 22, even when the sofa table 30 is in the open position, and therefore provides an aesthetically more appealing sofa.

Those skilled in this art will appreciate that, although the upper pivot link 45 is illustrated as L-shaped, it can take any configuration that includes therein a bend disposed toward the lower pivot link 45 in the closed position, such as C-shaped, V-shaped, U-shaped, obtuse-angled, and the like, and retain the advantages described herein. Further, a straight upper pivot link 45 could be employed with this mechanism, but would require either a shorter upper table surface 31 an exposed outboard mounting over the armrests 39, 39*a*, or a lower mounting location of mounting link 41 on side panel 24.

Figure 4:
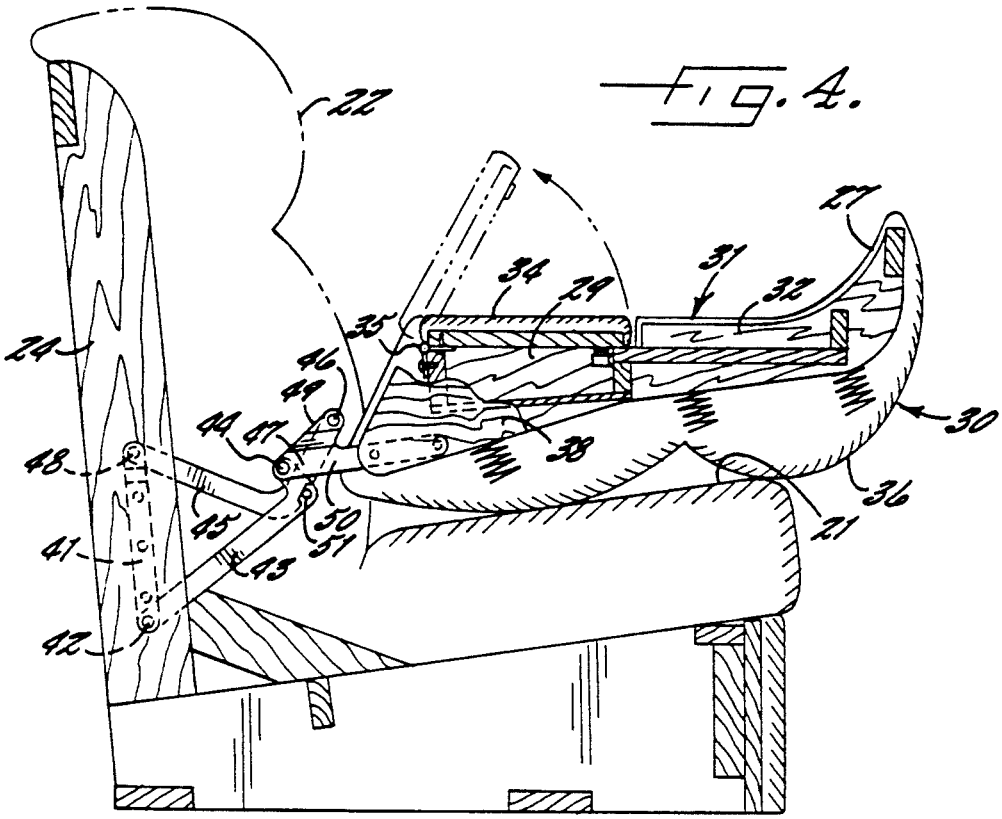
FIG. 4 is a sectional view taken along line 4—4 of FIG. 1 showing a sofa table and mechanism in the open position.

The operation of the sofa table 30 and mechanism 40 can be best understood by comparing its orientation in the closed position shown in FIG. 5 to its orientation in the open position shown in FIG. 4. In FIG. 5, the sofa table 30 is shown in its upright or closed position, with the table arm 50 of the mounting bracket 47 and, accordingly, the upper support surface 31 being disposed generally upright. Note that pivots 48, 46, and 44 are virtually aligned in an "on-center" condition; while not present in this embodiment, one skilled in the art will understand that a true "on-center" condition for these pivots would create a locking mechanism which would help to retain the sofa table 30 in the upright position. As a force is directed forwardly at the top of the sofa table 30, the pivot arm 49 of the mounting bracket 47 rotates about pivot 44 so that the table arm 50 moves downwardly and forwardly. This action causes the upper pivot link 45 to rotate about pivot 48 so that pivot 46 moves upwardly and forwardly and also causes the lower pivot link 43 to rotate about pivot 42 so that pivot 44 moves upwardly and rearwardly. As the rotation of the lower pivot link 43, the upper pivot link 45 and the mounting bracket 47 continue, the upholstered surface 36 of the sofa table 30 rotates forwardly and downwardly to a position where it generally parallels the seat surface 21 of the sofa 20. This motion continues until the lower pivot link 43 and the upper pivot link 45 rotate to a position wherein the stop pin 51 of the lower pivot link 43 contacts the upper pivot link 45, at which point rotation ceases. During operation, the upper support surface 31 of the sofa table 30 and the table arm 50 of the mounting bracket 47 each rotate from a first rotative orientation in the closed position to a second rotative orientation in the open position which is generally between about 75 and 120 degrees from the first rotative position.

It should be noted that, as is clear in FIG. 4, when the sofa table 30 is in the open position, the entirety of the mechanism 40 is disposed below a plane defined by the upper support surface 31 of the sofa table 30. This orientation provides a much more appealing seating unit when viewed by an observer facing the front of the sofa 30, as all of the linkages of the mechanism 40 are hidden from view.

Figure 6:
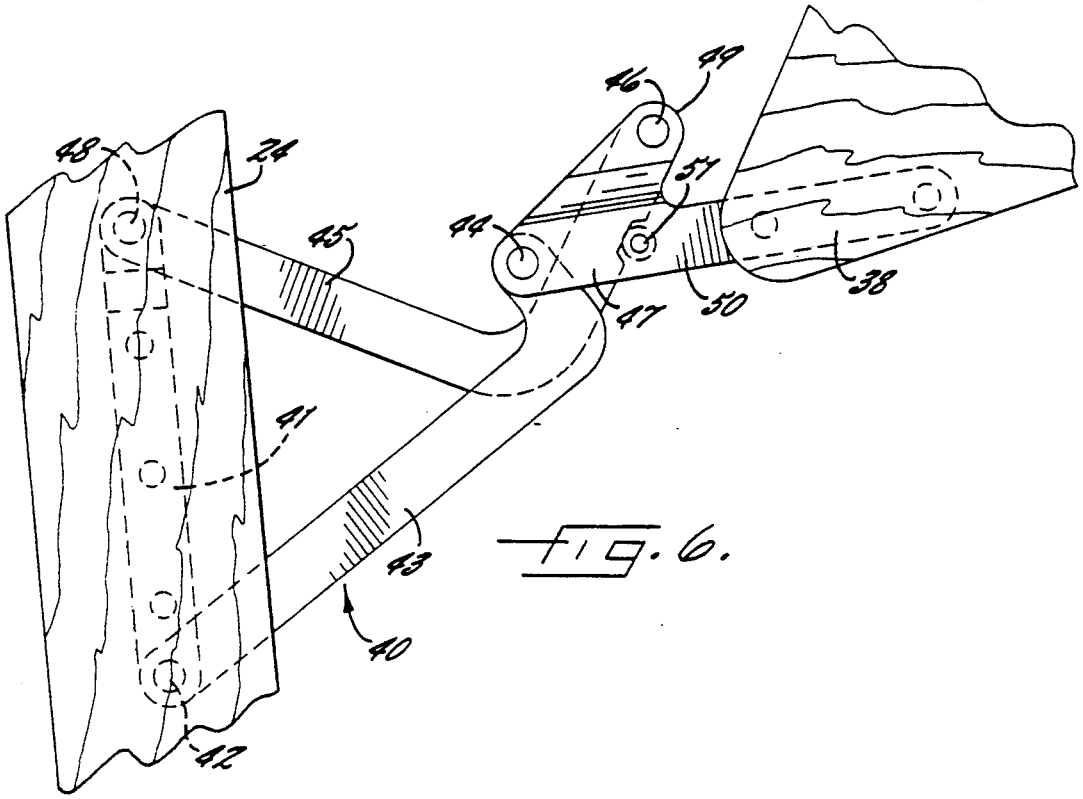
FIG. 6 shows an enlarged side view of an alternative embodiment of the sofa table mechanism in the open position, wherein the stop pin is located on the mounting bracket.
Figure 7:
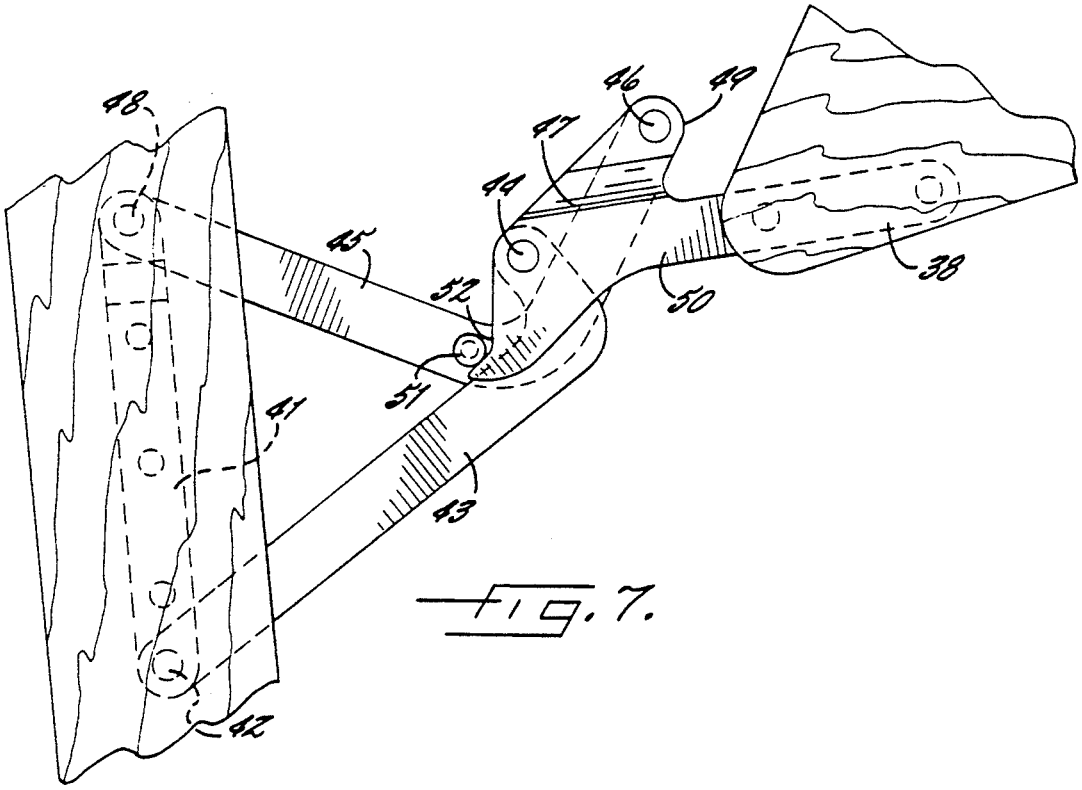
FIG. 7 shows an enlarged side view of an alternative embodiment of the sofa table mechanism wherein the stop pin is located on the upper pivot link.

FIG. 6 shows an alternative embodiment of the mechanism 40 wherein the stop pin 51 is located on the table arm 50 of the mounting bracket 47 rather than on the lower pivot link 43. In this embodiment, the other links retain the same configuration as in the embodiment in FIGS. 1–5. FIG. 7 shows another alternative embodiment, wherein the stop pin 51 is located on the upper pivot link 45. In this embodiment the shape of the mounting bracket 47 is altered slightly to include a bearing surface 52 which contacts the stop pin 51 to cease motion of the sofa table 30.

Figure 8:
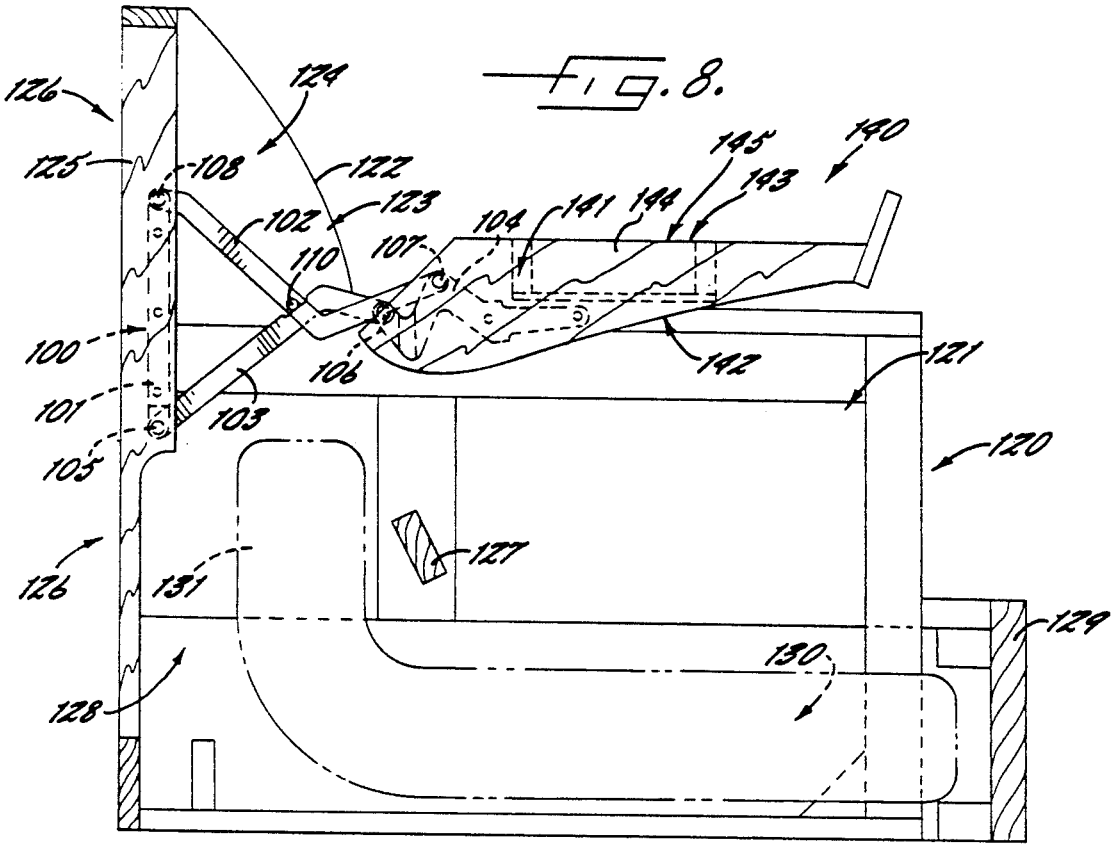
FIG. 8 shows a side view of a sofa table and mechanism suitable for use with a foldable bed in the open position.
Figure 9:
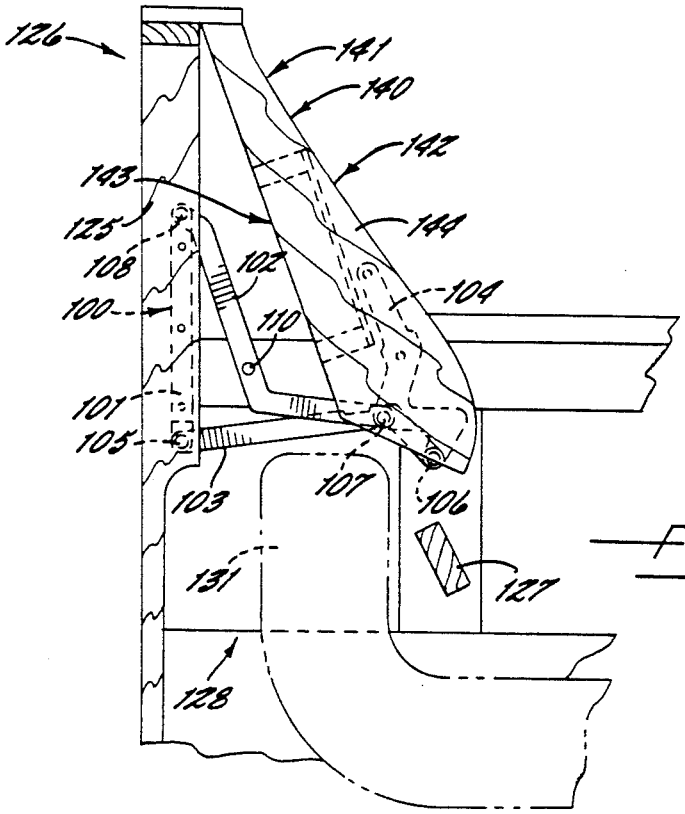
FIG. 9 shows a side view of a sofa table and mechanism suitable for use with a foldable bed in closed position.

An additional embodiment of the present invention is illustrated in FIGS. 8 and 9. This embodiment is designed to permit the use of a sofa table of the present invention with a sofa which is attached to a foldable bed that can be stored within the cavity of the sofa beneath the seat surface and backrest. See, e.g., U.S. Pat. No. 4,918,770 to Hartline et al. When stored, the bed is said to be in its closed position; the large majority of the bed folds upon itself and is stored beneath the seat of the sofa, and the head portion of the bed folds to a generally vertical position and resides beneath the lower portion of the backrest. The alternative embodiment of the present invention illustrated in FIGS. 8 and 9 can be moved between the open and closed positions described above for other embodiments of the invention without interference from the head portion of the bed.

Referring now to FIG. 8, a sofa, shown generally at 120, includes a support frame 126, a generally horizontal seat 121 attached to the forward portion of the support frame 126, and a generally upright backrest 122 attached to the support frame 126 upward and rearward of the seat 121. The backrest 122 has a forward facing backrest surface 123 which includes a recessed area 124, behind which are mounted a pair of mounting panels 125 (only one shown). Also, beneath the upper seat surface of the seat 121 is a breastrail 127 which extends between lateral edges of the sofa-bed 120. The support frame 126, the seat 121, and the backrest 122 form a cavity 128 within the sofa 120 located beneath the seat 121 and the backrest 122.

Within the cavity 128, a foldable bed 130 is stored in its folded, or closed, position. When the bed 130 is in the closed position, the head portion 131 of the bed 130 is disposed generally upright beneath the backrest 122 and generally rearward of the breastrail 127 of the sofa 120; in this position, the head portion 131 extends to a position slightly higher than the remainder of the bed 130. The bed 130 can be moved from this closed position to an open position (not shown) in which the entirety of the bed is disposed generally horizontally in a position above and forward of the forward portion 129 of the support frame 126.

Those skilled in this art will appreciate that, although the sofa 120 is illustrated herein, the invention is suitable for use with any seating unit, including a chair, a loveseat, and the like, which includes a seat, a backrest, and a frame of sufficient size to house a folded bed. The invention can also be used with a pit-style modular sofa or chair of sufficient size. Although most advantageously used with a seating unit which includes a foldable bed of the type illustrated herein, the invention will operate equally well with a seating unit that includes a bed which folds differently from that illustrated herein as long as no portion of the bed protrudes into the backrest 122 to a height at which it interferes with the movement of the sofa table 140 or the mechanism 100; in addition, the invention is also operable with a seating unit which lacks a bed altogether.

A pair of mechanisms designated broadly at 100 are fixedly mounted to the inboard surfaces of the mounting panels 125. It will be understood by those skilled in this art that there is a plane of symmetry for the sofa 120 (located between and equidistant from the mounting panels 125 and oriented to be normal to the breastrail 127) which divides the sofa 120 into two mirror images; except where noted, for brevity and clarity only one mechanism 100 will be described herein, with the understanding that the description applies equally to the mirror image mechanism on the opposite side of the plane of symmetry.

The mechanism 100 comprises a mounting link 101, an upper pivot link 102 pivotally interconnected with the mounting link 101 at a pivot 108, a lower pivot link 103 pivotally interconnected to the mounting link at a pivot 105 located on the mounting link downwardly from pivot 108, and a mounting bracket 104, which is pivotally interconnected to the upper pivot link 102 at a pivot 107 and is further pivotally interconnected with the lower pivot link 103 at a pivot 106. The pivot 106 is located forwardly on the lower pivot link 103 from the pivot 105; likewise, the pivot 107 is located forwardly on the upper pivot link 102 from the pivot 108. The pivot 107 is located on the mounting bracket 104 so that in the closed position shown in FIG. 9, the pivot 107 is disposed above and rearwardly of the pivot 106. Attached to the upper pivot link 102 is a stop pin 110.

Each of the pair of mechanisms 100 supports a respective edge of a sofa table broadly designated at 140. The sofa table includes a frame 141 which includes a pair of side panels 144, an upholstered decorative surface 142 which faces generally forwardly when the sofa table is in its closed position and generally downwardly when the sofa table is in its open position, and a table surface 143 which faces generally rearwardly in the closed position and generally upwardly in the open position. The table surface 143 includes a storage box 145. The sofa table 140 is mounted to the pair of mechanisms 100 by fixed attachment of the mounting brackets 104 to the inboard surfaces of table side panels 144, although those skilled in this art will recognize that any means which fixedly mounts the mounting bracket 104 to the table frame 141 is suitable, including attachment to a back panel, front panel, side panel, or even to the table surface 143.

The mounting link 101 provides a fixed position for the mechanism 100 relative to the mounting panel 125. Although the mounting link 101 is illustrated herein to perform this function, those skilled in this art will appreciate that any attachment means that provides fixed pivots for the upper pivot link 102 and the lower pivot link 103 relative to the mounting panel 125, such as apertures for receiving pivot pins upon which these links can pivot, sleeve bearings, and the like, is suitable for use with the invention. Further, those skilled in this art will recognize that, although the mounting link 101 is illustrated as a substantially straight link, it can take any configuration which does not interfere with the movement of the mechanism between its open and closed positions.

The upper pivot link 102 includes a bend disposed toward the lower pivot link 103 in the open position. A "bend" as used herein means a nonlinearity, such as an arc or an angle, in the length of a link which causes both long edges of the link to protrude from a straight line between its pivot points in a direction parallel to the plane of travel of the link. By "disposed toward," it is meant herein that the bend in the upper pivot link 102 draws portions of the upper pivot link nearer a line between pivot 105 and pivot 106 (simulating a straight link 103) than if the upper pivot link 102 were a straight link. The bend in the upper pivot link 102 is included in order to confer to the mechanism 100 the advantages described above for the embodiments of the invention shown in FIGS. 1–7. The upper pivot link also includes a slight bend near pivot 108, the vertex of which is disposed away from the lower pivot link 103 in the open position, thereby forming a shallow S-shape. As used herein, "disposed away from" has the opposite meaning of "disposed toward," in that the protrusion of the link draws portions of upper link 102 farther away from an imaginary straight link 103 than would a straight link between the pivots 107 and 108. Those skilled in this art will appreciate that, as described above, although the upper pivot link 102 is illustrated as roughly S-shaped, it can take any configuration that includes therein a bend disposed toward the lower pivot link 103 in the closed position, such as C-shaped, V-shaped, U-shaped, obtuse-angled, and the like, and retain the advantages described herein. Further, a straight upper pivot link 102 could be employed with this mechanism, but may require either a shorter upper table surface 143, an outboard mounting of the mechanism 100 on the table side panels 144, or a lower mounting location of the mounting link 101 on the side panel 125.

In contrast to the embodiments illustrated in FIGS. 1–7, the lower pivot link 103 includes therein a bend disposed toward the upper pivot link 102 in the open position. In this instance, "disposed toward" means that the bend in link 103 draws portions of the link 103 nearer to an imaginary straight link 102 (i.e., a link following a straight line between pivots 107 and 108) than if link 103 were a straight link. This bend is included to allow the mechanism 120 to be used in conjunction with a sofa 100 which includes a foldable bed 130. The advantage conferred by including the bend in the lower pivot link 103 is best illustrated in FIG. 9; if the lower pivot link 103 were a straight link between pivots 105 and 106, the head portion 131 of the bed 130 would interfere with the lower pivot link 103 and would not allow this link, and accordingly, the mechanism 100, to move completely into its closed position. However, by including a bend in the lower pivot link 103 disposed toward the upper pivot link 102, in the closed position the link 103 does not contact the head portion 131 of the bed 130, which instead "nests" within the bend of the lower pivot link 103 so that the lower pivot link 103 adjacently overlies the head portion 131 in noncontacting relation. This configuration thus permits the sofa table 140 to move completely into its closed position within the recessed area 124 of the sofa 120. Although the lower pivot link is illustrated herein as a dogleg-shaped link, it can take any configuration that includes therein a bend disposed toward the upper pivot link 102 in the closed position, such as C-shaped, V-shaped, U-shaped, obtuse-angled, and the like, which will prevent interference with the head portion of a foldable bed.

The mounting bracket 104 is shown herein as a serpentine-shaped piece. The serpentine configuration is selected for manufacturing advantage and to allow sufficient room above its forward portion for the inclusion of a storage box 145 within the sofa table 140. Those skilled in this art will appreciate that any means which mounts the sofa table 140 to the upper pivot link 102 at the pivot 107 and the lower pivot link 103 at the pivot 107 is suitable for use with the invention. Such a means can comprise apertures in the side panels 141 to receive pivot pins, sleeve bearings received within the side panels, and the like.

The mechanical operation of the mechanism 100 and the sofa table 140 is similar to that of the earlier illustrated embodiments. To move the sofa table 140 from the closed position of FIG. 9 toward the open position of FIG. 8, first the operator applies a force to the top edge of the sofa table 140 directed toward the forward portion of the sofa 120. This action causes the sofa table 140 to rotate (clockwise as shown in FIG. 9); because the mounting bracket 104 is fixed to the side panel 141 of the sofa table 140, the mounting bracket 104 rotates in a similar manner. This rotation of the mounting bracket 104 causes the pivot 107 to move upwardly and forwardly; also, this action also draws the pivot 106 upwardly and rearwardly. The movement of pivot 106 forces the lower pivot link 103 and the upper pivot link 102 to rotate counterclockwise (as shown in FIG. 9) about the pivots 105 and 108, respectively.

This motion continues until the lower pivot link 103 contacts the stop pin 110 on the lower upper pivot link 102. Although the stop pin 110 is illustrated herein, those skilled in this art will appreciate that any means for halting the motion of the links of the mechanism, such as a limited-length spring, a non-elastic strap, spring-loaded stop mechanisms, alternative configurations of the links of the mechanism 100, and the like, can be used with the present invention. Also, although the stop pin 110 is shown to be attached to the upper pivot link 102, it will be understood by those skilled in this art that the stop pin could also be attached to locations on the lower pivot link 103, the mounting bracket 104, or even the mounting link 101, and still halt the motion of the sofa table 140 in a desirable open position.

Figure 10B:
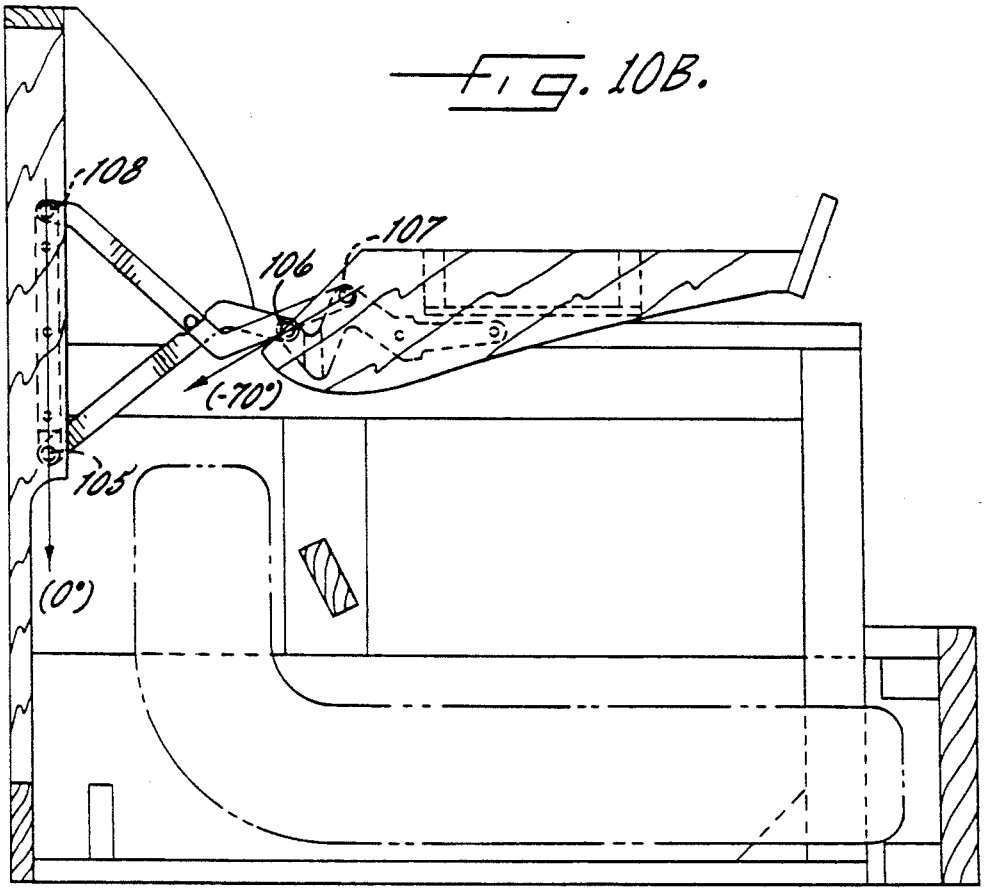
FIGS. 10A and 10B are schematic representations illustrated the calculation of the determination of the rotative positions of a mechanism of the present invention and the angular difference therebetween.
Figure 10A:
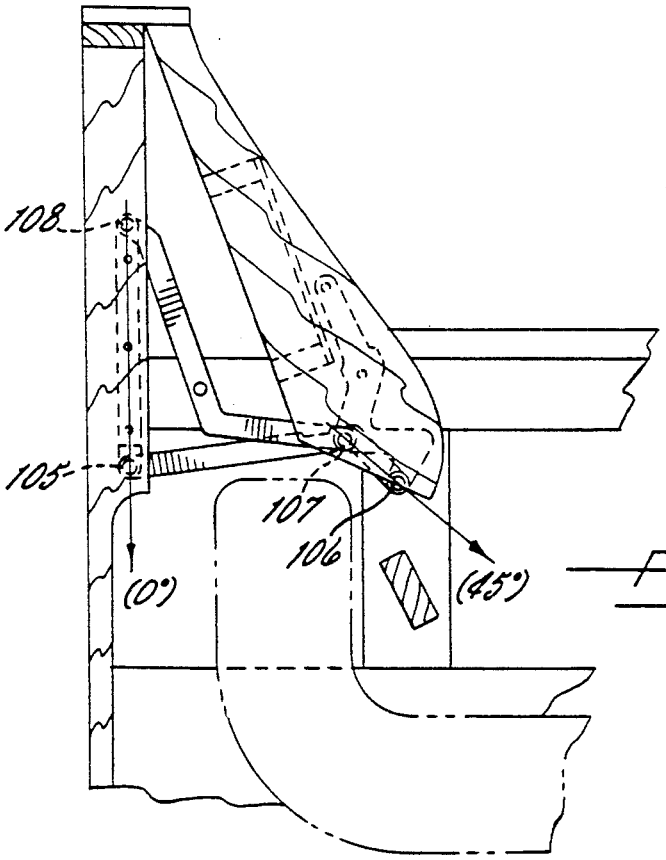

Looking at the motion of the mechanism 100 alone, in the closed position, the mounting bracket 104 has a first rotative orientation relative to the mounting link 101. Relative rotative orientation, as used herein, is best understood by reference to FIGS. 10A and 10B. Relative rotative orientation is determined by scribing a first vector through two arbitrary points (for example, pivots 105 and 108) on the stationary mounting link 101 to define an origin angle of 0°, scribing a second vector between two arbitrary points (for example, pivots 106 and 107) on the mounting bracket 104, and determining the angle between the first and second vectors. As seen in FIG. 10A, in the closed position, using the exemplary pivots as the arbitrary points, assuming a first vector directed downwardly from pivot 108 through pivot 105, and assuming a second vector directed downwardly and forwardly from pivot 107 through pivot 106, the first relative orientation is approximately 45°. In the open position (FIG. 10B), using the same points, retaining the same first vector, and retaining the same relative direction for the second vector (i.e., originating at pivot 107 and extending through pivot 106), the relative rotative orientation of the mounting bracket 104 to the mounting link 101 in the open position is approximately −70°. The angular difference between the first relative rotation and the second relative rotation in the illustrated embodiment is approximately 45°−(−°70), or 115°, which represents the angular change of the table surface 143 of the sofa table 140 relative to the stationary sofa 120 between the open and the closed positions. Those skilled in this art will appreciate that the present invention should be useful in moving sofa tables between an open and a closed position in which the difference between the first relative rotative position of the mounting bracket 104 to the mounting link 101 (taken in the closed position) and the second relative position between these links (taken in the open position) is between about 90° and 140°, and is more preferably between about 100° and 135°.

To return the sofa table 140 to the closed position, the operator applies an upward force to the forward edge of the sofa table 140. This action causes downward and forward movement of the pivot 106, and further causes downward and rearward movement of the pivot 107, which movement causes the upper pivot link 102 and the lower pivot link 103 to rotate counterclockwise from the open position as viewed in FIG. 8. Alignment of the pivots 106, 107 and 108 coincides with the return of the sofa table 140 to its closed position within the recessed area 124 of the backrest surface 122.

Although not illustrated in the drawings, the present invention can also be used when the foldable bed 130 is in its open or unfolded position. In its open position, the bed 130 is generally horizontal at a height approximately equal to the height at which the seat surface 122 resides when the bed 130 is in its folded position. When the bed 130 is in its open position, the sofa table 140 can open and rest atop the upper mattress surface of the unfolded bed, thereby providing a table surface for occupants seated or reclining on the mattress surface.

The drawings and specification disclose typical preferred embodiments of the invention, and, although specific terms are employed, they are used in a generic and descriptive sense only and not for the purpose of limitation, the scope of the invention being set forth in the following claims.

That which is claimed is:

1. A seating unit comprising:

(a) a seat assembly including:

(i) a support frame;

(ii) a seat attached to said support frame having a generally horizontal seat surface;

(iii) a backrest attached to said support frame upward and rearward of said seat surface and having a generally upright and forwardly facing backrest surface, said backrest surface having a recessed area; and (iv) a pair of mounting panels fixed to said support frame rearwardly of said recessed area of said seat surface;

wherein said seat, said backrest, and said support frame enclose a cavity for storing a foldable bed;

(b) a foldable bed having a head portion, said bed being mounted to said support frame and being foldable from a generally horizontal open position to a folded closed position within said cavity of said seat assembly, wherein said head portion is disposed generally upright and generally beneath said backrest;

(c) a pair of mechanisms for moving a sofa table between an open position and a closed position, each of said pair of mechanisms comprising:

i) means for mounting said mechanism to said mounting panels;

ii) a lower pivot link pivotally interconnected to said attaching means;

iii) table mounting means pivotally interconnected to said lower pivot link; and iv) an upper pivot link pivotally interconnected to said panel mounting means upwardly of the pivot of said mounting means and said lower pivot link and further pivotally interconnected to said table mounting means;

wherein said lower pivot link includes a bend between its pivots disposed toward said upper pivot link; and (d) a sofa table comprising:

i) a support frame which includes means for attaching said sofa table to said one of said table mounting means;

ii) a decorative surface attached to said sofa table support frame;

iii) a support surface attached to said sofa table support frame generally opposite and facing away from said decorative surface;

said sofa table being movable between a generally upright closed position, in which said sofa table resides within said recessed area with said decorative surface facing generally forward and being generally parallel with said backrest surface, and in which said lower pivot link adjacently overlies said head portion of said folding bed when said bed is in its closed position, and a generally horizontal open position, in which said decorative surface faces and is adjacent said seat surface and said support surface faces generally upwardly.

2. A seating unit according to claim 1, wherein said upper pivot link includes a bend disposed toward said lower pivot link.

3. A seating unit according to claim 1, wherein said panel mounting means comprises a mounting link.

4. A seating unit according to claim 1, wherein said table mounting means comprises a mounting bracket.

5. A seating unit according to claim 1, wherein said mechanism comprises means for halting the motion of said mechanism as it reaches the open position.

6. A seating unit according to claim 4, wherein said halting means comprises a stop pin attached to said upper pivot link.

7. A seating unit according to claim 1, wherein said seating unit is a sofa.

8. A seating unit according to claim 1 wherein in its open position, said foldable bed resides at a height which is sufficiently low that said sofa table can move to its open position.

9. A mechanism suitable for use with a retractable sofa table comprising:

(a) means adapted for mounting said mechanism to a sofa frame;

(b) a lower pivot link pivotally interconnected to said attaching means;

(c) sofa table mounting means pivotally interconnected to said lower pivot link and adapted to be fixed to a sofa table; and (d) an upper pivot link pivotally interconnected to said sofa frame mounting means, and further pivotally interconnected with said sofa table mounting means;

wherein said lower pivot link includes a bend between its pivots disposed toward said upper pivot link; so that in a first closed position, said table mounting bracket is in a first rotative orientation relative to said mounting means, and in a second open position, said table mounting bracket is in a second rotative orientation relative to said mounting means, the angular difference between the first rotative position and the second rotative position being between about 90° and 140°.

10. A mechanism according to claim 9, wherein said upper pivot link includes a bend disposed toward said lower pivot link.

11. A mechanism according to claim 9, wherein said upper pivot link further comprises a second bend between said first bend and said pivot with said sofa frame mounting means, said second bend being disposed away from said lower pivot link.

12. A mechanism according to claim 9, further comprising means for halting the motion of said mechanism as it reaches the second relative rotative position.

13. A mechanism according to claim 12, wherein said halting means comprises a stop pin.

14. A mechanism according to claim 13, wherein said stop pin is attached to said upper pivot link.

* * * * *